United States Patent [19]

Stuckmann et al.

[11] 4,148,592

[45] Apr. 10, 1979

[54] SHIELD APPARATUS FOR USE IN TUNNELLING

[75] Inventors: Dieter Stuckmann, Selm; Hans Jütte, Dortmund-Brechten, both of Fed. Rep. of Germany

[73] Assignee: Gewerkschaft Eisenhutte Westfalia, Lunen, Fed. Rep. of Germany

[21] Appl. No.: 859,518

[22] Filed: Dec. 12, 1977

[30] Foreign Application Priority Data

Dec. 16, 1976 [DE] Fed. Rep. of Germany ..... 2657003

[51] Int. Cl.[2] ..... E01G 3/00

[52] U.S. Cl. ..... 405/141

[58] Field of Search ..... 61/85, 84, 41 A; 52/632, 726, 729

[56] References Cited

U.S. PATENT DOCUMENTS

| | | | |
|---|---|---|---|
| 3,411,826 | 11/1968 | Wallers et al. | 61/85 |
| 3,427,813 | 2/1969 | Hayes | 61/85 |
| 3,509,669 | 5/1970 | Plemeng | 52/729 |
| 3,823,566 | 7/1974 | Handewith | 61/85 |

FOREIGN PATENT DOCUMENTS

| | | |
|---|---|---|
| 1064710 | 8/1954 | Fed. Rep. of Germany. |
| 1955355 | 11/1970 | Fed. Rep. of Germany. |
| 2021734 | 3/1973 | Fed. Rep. of Germany. |

*Primary Examiner*—Jacob Shapiro

*Attorney, Agent, or Firm*—Sughrue, Rothwell, Mion, Zinn and Macpeak

[57] ABSTRACT

Shield apparatus for tunnelling comprises a framework supporting drive members advanced individually or in groups as known per se. The framework and its drive members are carried by a pair of elongate floor beams arranged at the sides of the tunnel wall. Each floor beam has a longitudinal slot or groove therein which is open to the rear end of the beam. This slot or groove receives anchoring pins fitted in situ into the floor of the tunnel working so that the beams can slide along the pins in the direction of advancement.

19 Claims, 6 Drawing Figures

FIG.5
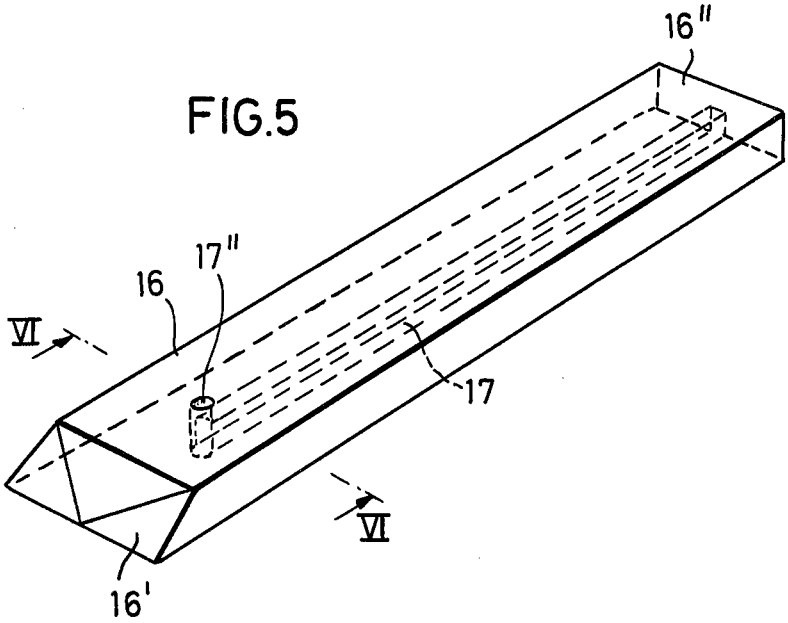
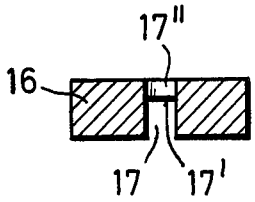
FIG.6

SHIELD APPARATUS FOR USE IN TUNNELLING

BACKGROUND TO THE INVENTION

The present invention relates in general to shield apparatus for use in driving tunnels or similar excavations.

One well known form of shield or tunnelling apparatus has a series of cutting members or planks arranged side-by-side and supported by one or more frames. The cutting members are then advanced individually or in groups with the aid of hydraulic rams to effect the driving progress. In German Patent Specification No. 2021734 apparatus of this type is described wherein two frames are shifted alternately and support the aforementioned cutting members. The frames of this apparatus can be expanded, and to provide a rigid abutment for the shifting rams, the frames can be fixed to the floor of the working by means of anchoring pins driven into the floor by hydraulic presses. The frames can only be shifted when the anchoring pins are released. In this known apparatus additional components such as hydraulic props, horizontal bracing beams and transverse floor beams obstruct the open space inside the shield and it is difficult to use additional machinery inside the shield.

It is generally desirable to utilize cutting machinery which rests on the floor of the tunnel inside a shield since inter alia vibration caused by the operation of the machinery need not then be transmitted to the shield itself.

This necessitates a shield structure which is kept open at the floor but in this case the shield is not particularly stable and cannot resist side pressure so well as a shield braced at the floor.

A general object of this invention is to provide an improved shield apparatus wherein the floor region is basically unobstructed while there is adequate bracing against lateral forces.

SUMMARY OF THE INVENTION

In accordance with the invention the shield apparatus is provided with floor beams secured by floor anchors against lateral forces and guided by the same anchors for movement in the advancing direction.

In one aspect of the invention shield apparatus may have frame means supporting the tunnel wall and carried on at least one structure arranged at the floor of the working, wherein said structure engages on anchoring means on the floor which permit sliding of the structure in the direction of advancement while restraining lateral movement.

In one embodiment of the invention shield apparatus comprises a framework, a plurality of drive members displaceably supported by the framework and arranged in side-by-side relationship against the tunnel wall, elongate floor beams supporting the framework and anchoring elements fixed in the floor of the working and projecting upwardly thereof, the anchoring elements engaging with the floor beams to permit longitudinal displacement of the floor beams in the direction of advancement and to restrain lateral movement. By arranging the floor beams at the sides of the tunnel wall the floor area inside the shield can be free and unobstructed. This allows machinery to work freely on the floor without imparting unnecessary vibration to the shield itself. Nevertheless the shield is adequately braced against lateral forces by the anchoring elements or pins engaging with the floor beams. The anchoring elements or pins can be fixed, with resin or some other bonding substance, into bores drilled in situ into the floor of the tunnel working. Although the framework can be fixed to the floor beams it is preferable to allow relative displacement between these components in the driving or advancing direction while again restraining lateral movement. Hydraulic rams can thrust the floor beams forwardly in relation to the framework in a similar manner to the drive members and it is desirable to provide cutting edges at the front ends of the floor beams. Positive guides are preferably provided between the framework on the one hand and the drive members and floor beams on the other hand.

Conveniently, the anchoring pins can engage in recesses or slots or grooves in the floor beams. Preferably the pins do not project above the upper surface of the beams but slide along the recesses to pass out from open rear ends of the beams. Additional slidable devices can be mounted on the beams to inhibit inherent lateral movement thereof.

A drilling machine which is held and guided inside the shield apparatus can serve to drill the bores in the tunnel floor to take the anchoring pins. The bores can be drilled with location and guidance through the floor beams.

The invention can also provide a special floor beam component for shield apparatus. The floor beam component is of elongate form and is characterized by a recess extending longitudinally of the beam component, said recess being open at least to the underside and rear ends of the beam component and serving to receive anchoring elements fitted to the floor of an excavation working and which permit longitudinal displacement of the beam while restraining lateral displacement.

During use of shield apparatus employing floor beams as described for carrying frame means, the steps of alternately moving the floor beams in the direction of advancement and installing upstanding anchoring elements at the floor of the working to engage with the floor beams in the manner described would be performed.

The invention may be understood more readily and various other features of the invention may become apparent from consideration of the following description.

BRIEF DESCRIPTION OF DRAWINGS

Embodiments of the invention will now be described, by way of examples only, with reference to the accompanying drawings, wherein:

FIG. 5 is a diagrammatic perspective view of another floor support structure or beam for use in the apparatus shown in FIG. 1; and FIG. 6 is a sectional end view of the beam depicted in FIG. 5 and taken along the line VI—VI shown in FIG. 5.

DESCRIPTION OF PREFERRED EMBODIMENTS

Figure 1:
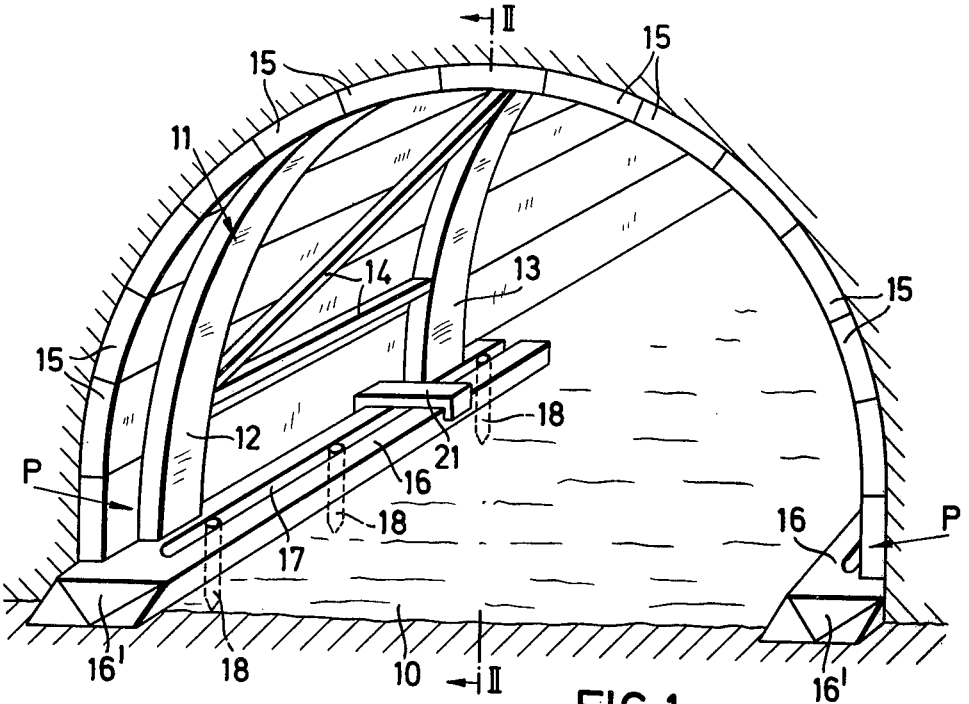
FIG. 1 is a diagrammatic perspective end view of shield apparatus made in accordance with the invention.
Figure 2:
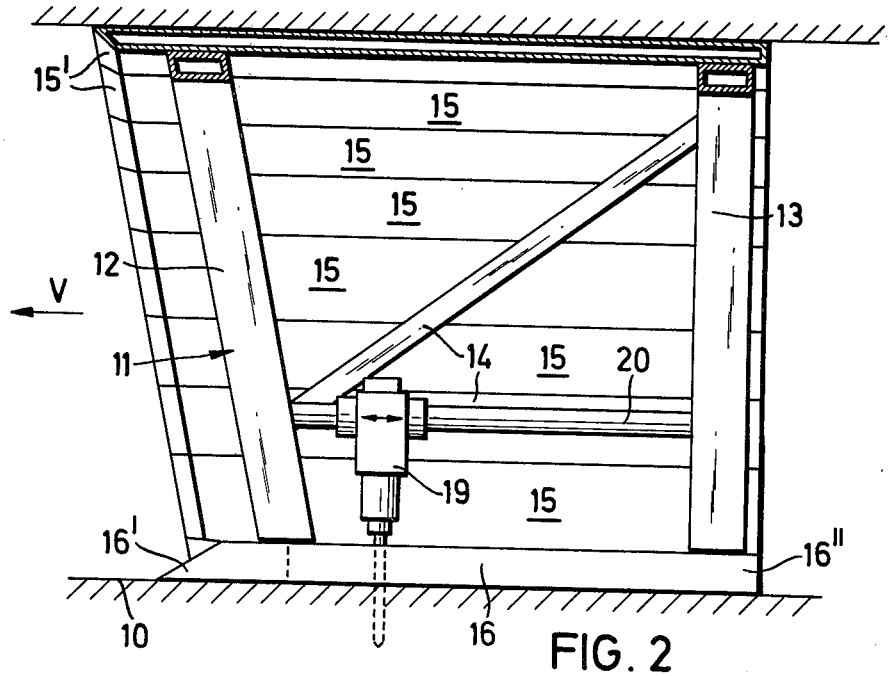
FIG. 2 is a sectional side view of the apparatus taken along the line II—II of FIG. 1.

As shown in FIGS. 1 and 2, shield apparatus is composed of a rigid framework 11 resting on two floor-engaging structures or beams 16 in an underground tunnel or other excavation working. The framework 11 carries a series of displaceable drive members or planks 15. The framework 11 is here constructed from two arcuate frame units 12, 13 spaced apart in the direction of driving the tunnel (indicated by arrow V in FIG. 2) and interconnected by bracing pieces 14. The drive members 15 are arranged side-by-side around the framework 11 in contact with the tunnel wall. Preferably, the members 15 are positively guided for longitudinal movement in relation to the framework 11. Conveniently T-shaped guide blocks at the underside of the members 15 may engage in slots in part of the framework 11.

The drive members 15 are provided with cutting edges 15' at their front edge to penetrate the working face. The members 15 are advanced in the direction of arrow V in FIG. 2 with the aid of hydraulic rams (not shown). The drive members 15 can be advanced individually or in groups. The shifting rams are mounted between the framework 11 and the associated drive members 15. When the drive members 15 are advanced the particular ram or rams in operation exert thrust force against the framework 11. This operative sequence is well known per se.

The beams 16 supporting the framework 11 and the drive members 15 rest on the floor 10 of the underground working at the sides of the tunnel walls. The beams 16 are elongate structures with cutting edges 16' at their front ends.

Figure 3:
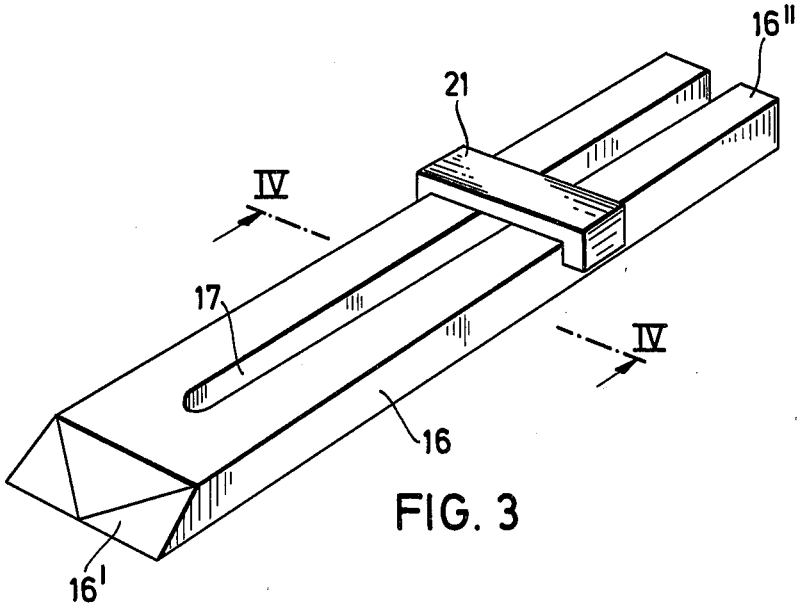
FIG. 3 is a diagrammatic perspective view of a floor support structure or beam of the apparatus shown in FIG. 1.
Figure 4:
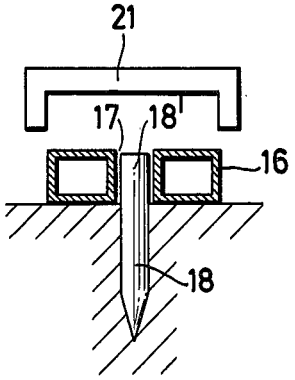
FIG. 4 is a sectional end view of the beam depicted in FIG. 3 and taken along the line IV—IV of FIG. 3.

As shown also in FIGS. 3 and 4, each beam 16 has a central longitudinal open slot 17 extending from its rear end 16" to near its front end having the cutting edge 16'. Each beam 16 is located and guided by anchoring elements which permit longitudinal movement of the beam 16 but restrain lateral movement (arrow P FIG. 1). In the embodiment shown in FIGS. 1 and 2, the anchoring elements take the form of simple upstanding pins 18 engaged into the floor 10 and extending into the slot 17 of the associated beam 16. A mobile drilling machine 19 (FIG. 2) can be mounted for sliding on a guide component 20, e.g., of the framework 11, and serves to drill bores in the floor 10 through the slot 17 of the associated beam 16 for receiving the pins 18. The pins 18 are firmly fixed into the bores holes thus formed with the aid of a resin or some other hardening fluid substance. The pins 18 are set so that their upper ends 18' terminate within the slot 17 below the upper surface of the associated beam 16. In this way the pins 18 do not interfere with the framework 11. To increase the stability of the slotted beams 16, U-shaped yokes 21 engage over the upper and side surfaces of the beams 16. The yokes 21 slide over the beams 16 without obstructing the framework 11 and serve to inhibit lateral flexure of the beams 16.

The framework 11 can be rigidly affixed to the floor beams 16 and thereby movable therewith as a unitary structure although it is preferred to arrange for the framework 11 to slide along the floor beams 16 in the direction of advance V. To provide for this slidable movement of the framework 11, the lower ends of the frame units 12, 13 can have T-shaped slots which receive T-shaped guide pieces or projections of the floor beams 16.

In similar manner to the drive members 15, hydraulic rams (not shown) are connected between the framework 11 and the floor beams 16.

During operation, the floor beams 16 are firstly advanced in relation to the framework 11 with the aid of the rams and the anchoring pins 18 are installed. Thereafter the drive members 15 are advanced in successive stages and finally the framework 11 is shifted up along the floor beams 16. The sequence is then repeated. As the floor beams 16 are advanced to commence the next driving cycle the anchoring pins 18 previously installed pass out from the rear ends 16" of the floor beams 16. Although the pins 18 can be removed usually they would be left in the floor 10.

The space inside the shield apparatus is essentially unobstructed and machinery such as various forms of cutting machines and/or conveyors can be arranged within the shield apparatus and can travel therealong to detach and remove the spoil or debris from the working face.

Another type of floor beam 16 is depicted in FIGS. 5 and 6 and this beam can be used in place of the beam 16 shown in FIGS. 3 and 4. In contrast to the beam 16 previously described the beam 16 of FIGS. 5 and 6 has a longitudinal central groove 17 in its underside which is closed to the upper surface of the beam 16. The groove 17 is open to the rear end 16" of the beam 16 and extends almost the entire length of the beam 16. At the front end portion of the beam 16 a vertical bore 17" extends through the beam 16 thus opening from the upper face of the beam 16 to the upper face 17' of the groove 17. This bore 17" enables the bores in the floor 10 to be drilled to a depth such that the anchoring pins 18 have their upper ends spaced from the upper face 17' of the groove 17. As before, the beam 16 can slide along over the pins 18 which pass out from the rear end 16" of the beam 16. The beam 16 constructed in this manner is more rigid than the slotted beam 16 shown in FIGS. 3 and 4 and the yokes 21 are not needed.

The beam 16 shown in FIGS. 5 and 6 may have several bores 17" instead of a single bore 17" as shown and instead of a single groove 17 it is possible to employ several parallel grooves 17 which slide along parallel rows of anchoring pins 18.

We claim:

1. Shield apparatus for use in tunnelling or the like; said apparatus comprising a framework, a plurality of drive members displaceably supported by the framework and arranged in side-by-side relationship against the tunnel wall, elongate floor beams supporting the framework and anchoring elements fixed in the floor of the working and projecting upwardly thereof, the anchoring elements engaging in slots in the floor beams to permit longitudinal displacement of the floor beams in the direction of advancement and to restrain lateral movement, the slots being open to the rear ends of the floor beams.

2. Apparatus according to claim 1, wherein the slots are also open to the upper and undersides of the floor beams.

3. Apparatus according to claim 1, wherein said anchoring elements terminate below the upper surfaces of the floor beams.

4. Apparatus according to claim 1, wherein slidable U-shaped yokes are provided on the floor beams.

5. Shield apparatus for use in tunnelling or the like; said apparatus comprising a framework, a plurality of drive members displaceably supported by the framework and arranged in side-by-side relationship against the tunnel wall, elongate floor beams supporting the framework and anchoring elements fixed in the floor of the working and projecting upwardly thereof, the anchoring elements engaging in grooves in the floor beams to permit longitudinal displacement of the floor beams in the direction of advancement and to restrain lateral movement, the grooves being open to the rear ends of the floor beams.

6. Apparatus according to claim 5, wherein said anchoring elements terminate below the upper surfaces of the floor beams.

7. Apparatus according to claim 5, wherein the grooves are also open to the undersides of the floor beams.

8. Shield apparatus for use in tunnelling or the like; said apparatus comprising a framework, a plurality of drive members displaceably supported by the framework and arranged in side-by-side relationship against the tunnel wall, elongate floor beams supporting the framework and anchoring elements fixed in the floor of the working and projecting upwardly thereof, the anchoring elements engaging in elongate recess means within the floor beams to permit longitudinal displacement of the floor beams in the direction of advancement and to restrain lateral movement, the anchoring elements terminating below the upper surfaces of the floor beams.

9. Apparatus according to claim 8, wherein the recess means in each floor beam is open to the rear end of said beam.

10. Apparatus according to claim 8, wherein said floor beams are disposed at the sides of the tunnel wall.

11. Apparatus according to claim 8, wherein the floor beams have cutting edges at their front ends.

12. Apparatus according to claim 8, wherein the framework is displaceably supported by the floor beams.

13. Apparatus according to claim 8, wherein the framework is fixedly supported by the floor beams.

14. Apparatus according to claim 8, wherein the recess means comprise grooves which are open to the underside and to the rear ends of the floor beams.

15. Apparatus according to claim 8, wherein at least one bore is provided in each of the floor beams to permit holes to be drilled in the floor to receive the anchoring elements.

16. Apparatus according to claim 8, wherein a drilling machine is provided for drilling holes in the floor to receive the anchoring elements.

17. Apparatus according to claim 16, wherein the drilling machine is slidably supported on a guide of the apparatus.

18. A method of driving tunnels or the like including the steps of alternately moving displaceable floor beams in the direction of advancement and installing upstanding anchoring elements at the floor of the working whereby said elements engage with the floor beams to guide the latter for longitudinal movement in the direction of advancement while restraining lateral movement and utilizing said floor beams to carry a shield supporting the tunnel wall.

19. A method according to claim 18, wherein the anchoring elements are inserted and fixed into bores in the floor formed by drilling through recesses in the floor beams.

* * * * *